US010797434B2

(12) United States Patent
Kurita

(10) Patent No.: US 10,797,434 B2
(45) Date of Patent: Oct. 6, 2020

(54) CONNECTOR

(71) Applicant: Sumitomo Wiring Systems, Ltd., Yokkaichi, Mie (JP)

(72) Inventor: Atsushi Kurita, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/393,243

(22) Filed: Apr. 24, 2019

(65) Prior Publication Data

US 2019/0356085 A1 Nov. 21, 2019

(30) Foreign Application Priority Data

May 16, 2018 (JP) ..... 2018-094459

(51) Int. Cl.
*H01R 13/58* (2006.01)

(52) U.S. Cl.
CPC ..... *H01R 13/582* (2013.01)

(58) Field of Classification Search
CPC ..... H01R 13/58; H01R 13/5804; H01R 13/5812; H01R 13/5816; H01R 13/5825; H01R 13/5845; H01R 13/585; H01R 13/5205; H01R 13/6593
See application file for complete search history.

(56) References Cited

U.S. PATENT DOCUMENTS 5,456,611 A * 10/1995 Henry ..... H01R 13/6395 439/180
6,056,586 A * 5/2000 Lin ..... H01R 13/506 439/460
6,089,912 A * 7/2000 Tallis ..... H01R 9/05 439/583
6,109,954 A * 8/2000 Lin ..... H01R 13/5816 439/460
6,644,996 B2 * 11/2003 Yamashita ..... H01R 13/641 439/352
7,086,897 B2 * 8/2006 Montena ..... H01R 9/0524 439/460
7,591,665 B2 * 9/2009 Nakamura ..... H01R 13/5812 439/374

(Continued)

FOREIGN PATENT DOCUMENTS

JP 2012-511804 5/2012

*Primary Examiner* — Edwin A. Leon
*Assistant Examiner* — Milagros Jeancharles
(74) *Attorney, Agent, or Firm* — Gerald E. Hespos; Michael J. Porco; Matthew T. Hespos

(57) ABSTRACT

A connector (10) includes a housing (12) having an opening (24) into which a cable (14) is inserted, and a retainer (16) is mounted on the housing (12) from the side of the opening (24). The retainer (16) includes locking lances (44) that face the cable (14) and are resiliently displaceable toward the cable (14) for holding the cable (14). The housing (12) includes cantilevered pressing portions (36). The pressing portions (36) displace the locking lances (44) toward the cable (14) to bring the locking lances (44) into contact with the cable (14) by pressing the locking lances (44) toward the cable (14). The retainer (16) includes displacement preventing portions (72) to prevent displacements of the pressing portions (36) in directions opposite to contacting directions with the locking lances (44) by contacting the pressing portions (36) in the directions toward the cable (14).

10 Claims, 10 Drawing Sheets

(56) References Cited

U.S. PATENT DOCUMENTS

| | | | | |
|---|---|---|---|---|
| 8,113,876 | B1 * | 2/2012 | Rossman | H01R 13/6593 439/578 |
| 8,672,705 | B2 * | 3/2014 | Schneider | H01R 13/5816 439/460 |
| 9,356,439 | B2 * | 5/2016 | Keith | H01R 13/5816 |
| 2006/0172578 | A1 * | 8/2006 | Parsons | H01R 13/5202 439/291 |
| 2010/0151721 | A1 | 6/2010 | Tyler | |
| 2011/0189876 | A1 * | 8/2011 | Schneider | H01R 13/631 439/271 |
| 2012/0051710 | A1 * | 3/2012 | Zeng | G02B 6/4472 385/137 |
| 2013/0029541 | A1 * | 1/2013 | Chiarelli | H01R 13/5205 439/781 |
| 2019/0157800 | A1 * | 5/2019 | Volker | G02B 6/3897 |
| 2019/0181583 | A1 * | 6/2019 | Schmidt | H01R 13/631 |

* cited by examiner

CONNECTOR

BACKGROUND

Field of the Invention

This specification relates to a connector.

Related Art

Japanese Unexamined Patent Application Publication No. 2012-511804 discloses a connector assembly that includes an external part assembly extending in a front-rear direction. An internal part assembly is arranged in the external part assembly and accommodates a terminal. A cable is connected to the terminal and extends rearward. A collet and a retainer have the cable inserted therethrough and are mounted on the external part assembly from behind.

Finger-like portions projecting rearward from an opening edge of an opening of the collet through which the cable is inserted. A plurality of stabilizing ribs are provided to project inward on the inner surface of the opening of the retainer through which the cable is inserted.

When the retainer is mounted on the external part assembly, the stabilizing ribs of the retainer press the finger-like portions of the collet inward so that the finger-like portions are pressed against the cable. In this way, the cable is held by the retainer and the collet.

However, the separate collet is necessary to hold the cable, thereby causing a problem of increasing the number of components. On the other hand, it is also considered to provide the retainer with holding pieces for sandwiching the cable and to provide the external part assembly with a pressing piece for pressing the holding pieces inward when the retainer is mounted. However, in this case, the pressing piece is deflected out by a reaction force of the cable, thereby causing a problem of reducing a holding force for the cable.

It is an object of the invention to provide a connector having an improved holding force for a wire.

SUMMARY

The invention relates to a connector with a housing having an opening into which a wire is inserted. A retainer is mounted on the housing from the opening side and includes at least one locking lance. The locking lance faces the wire and is resiliently displaceable substantially toward the wire. The retainer holds the wire by a resilient contact of the locking lance with the wire. The housing includes at least one cantilevered pressing portion. The pressing portion presses the locking lance toward the wire and thus resiliently displaces the locking lance toward the wire and into contact with the wire. The retainer includes at least one displacement preventing portion that is disposed and configured to contact the pressing portion substantially in the direction toward the wire and to prevent a displacement of the pressing portion in a direction opposite to a contacting direction with the locking lance.

Accordingly, the number of components can be reduced as compared to a configuration in which the wire is held by a separate component resiliently contacting the wire. Further, the displacement preventing portions of the retainer prevents a displacement of the pressing portion of the housing in the direction opposite to the contacting direction with the locking lances due to a reaction force of the wire generated by the resilient contact of the locking lance with the wire. In this way, a holding force for the wire is strong.

The locking lance may be brought substantially into surface contact with the wire. Additionally, a contact surface of the locking lance with the wire may have a curved shape that substantially conforms with an outer peripheral surface of the wire and/or may extend substantially extend in a circumferential extending direction of the wire. Since the contact surface of the locking lance and the wire is curved substantially in conformity with the outer peripheral surface of the wire and/or extends in the extending direction of the wire, a contact area of the locking lance and the wire can be larger.

At least one projection may project on a surface of the locking lance substantially facing the pressing portion.

Further, the pressing portion of the housing may project in a direction substantially opposite to a mounting direction of the retainer and may resiliently displace the locking lance toward the wire by pressing an end part of the projection substantially in a projecting direction.

The projection may be provided with at least one tapered surface inclined toward the facing surface of the locking lance in the mounting direction of the retainer from the end part of the projection in the projecting direction.

Since the pressing portion of the housing gradually displaces the locking lance toward the wire while sliding on the tapered surface of the projection when the retainer is mounted on the housing, an insertion force for the pressing portion is reduced and mounting the retainer on the housing is easier.

Two of the locking lances and two of the displacement preventing portions of the retainer and two of the pressing portions of the housing may be provided substantially across the wire.

Both ends of the displacement preventing portions may be coupled by a two coupling portions.

The wire is sandwiched by the locking lances. Thus, the holding force for the wire can be improved. Further, since both ends of the displacement preventing portions are coupled by the coupling portions, the displacement preventing portions are less deflectable by a reaction force of the wire and the holding force for the wire can be improved as compared to a configuration in which the coupling portions are not provided.

The two coupling portions may be provided substantially across the wire. Further, the coupling portions may include two projections projecting in directions intersecting resilient displacing directions of the locking lances from surfaces facing the wire, and ends of the projections may be in contact with the wire. Since the projections contact the wire in the directions intersecting the resilient displacing directions of the locking lances, displacements of the wire in the directions intersecting the resilient displacing directions of the locking lances can be restricted.

Accordingly, it is possible to provide a connector capable of suppressing a reduction in holding force for a wire.

These and other objects, features and advantages of the invention will become more apparent upon reading the following detailed description and accompanying drawings.

DETAILED DESCRIPTION

An embodiment is described with reference to FIGS. 1 to 10. In the following description, an X direction, a Y direction and a Z direction in FIGS. 1 to 10 are referred to as forward, rightward and upward directions.

Figure 1:
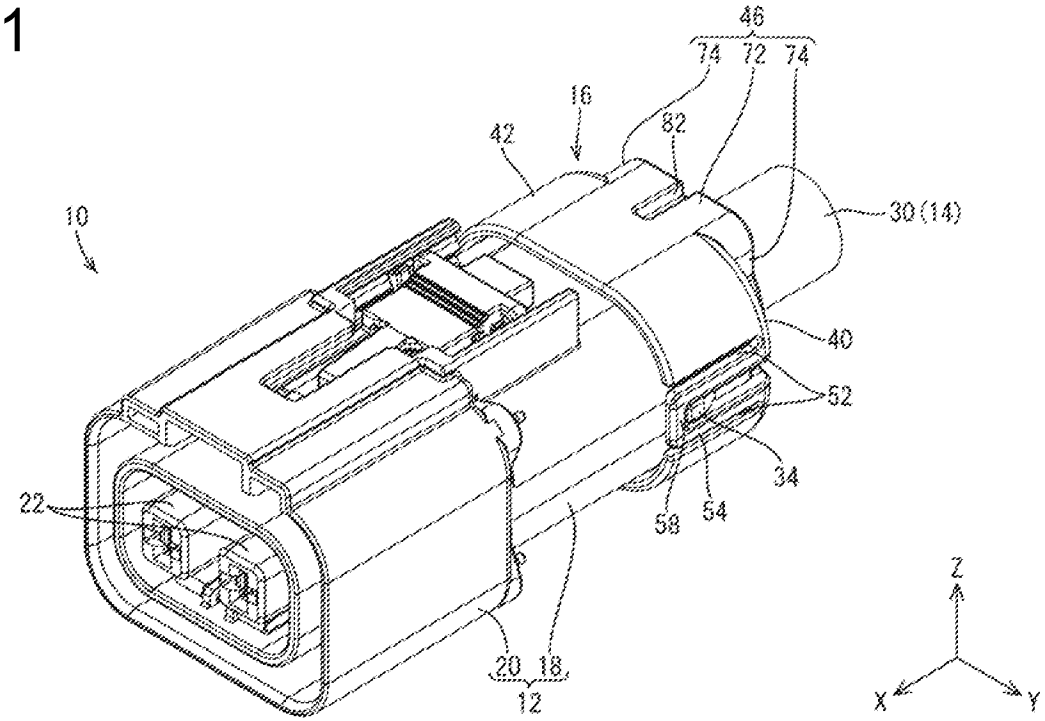
FIG. 1 is a front perspective view of a connector in an embodiment.

A connector 10 of this embodiment includes a housing 12 to be fit to a mating connector (not shown) and a retainer 16 to be mounted on the housing 12 from behind as shown in FIG. 1.

As shown in FIG. 1, the housing 12 comprises a terminal accommodating portion 18 having a tubular shape long in a front-rear direction and a forwardly open housing-side receptacle 20 is provided on the outer periphery of a front part of the terminal accommodating portion 18. Left and right rectangular tubular cavities 22 are provided in the terminal accommodating portion 18, and a terminal is accommodated in each of the cavities 22.

Figure 2:
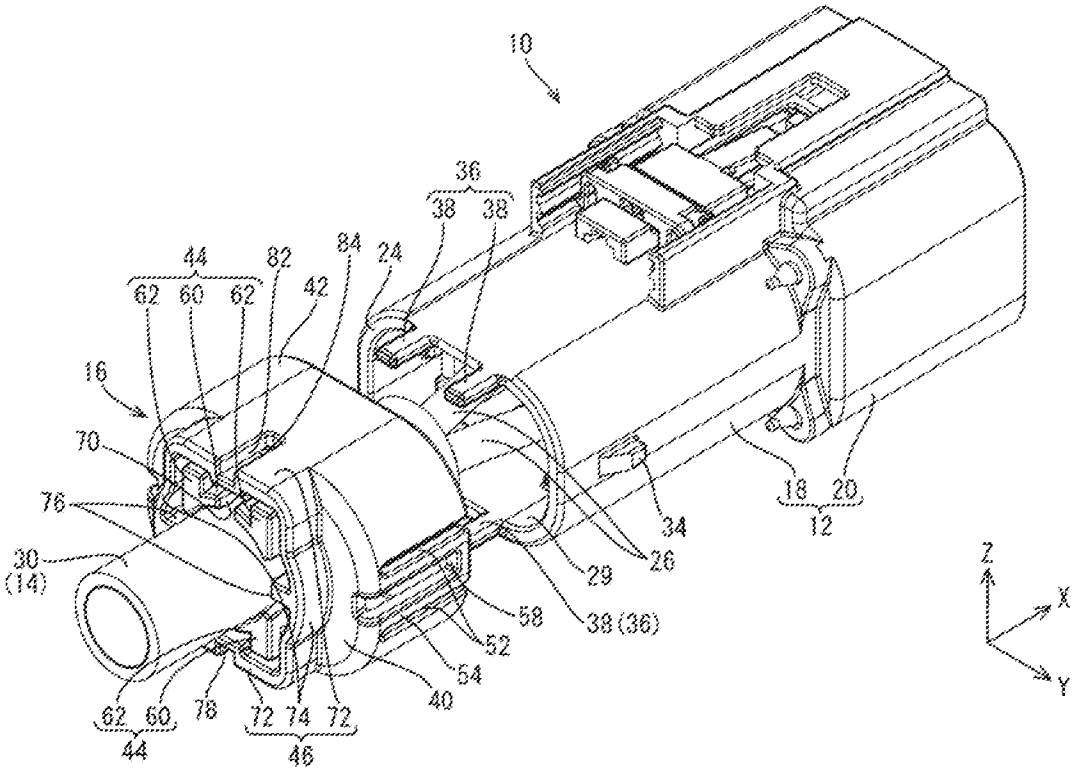
FIG. 2 is a rear perspective view of the connector before the mounting of a retainer.

As shown in FIG. 2, the terminal accommodating portion 18 has an opening 24 that opens rearward, and a cable is to be inserted into the opening 24. Specifically, a multicore cable 14 formed by bundling two coated wires 26 and covering the wires 26 with an outer coating is to be inserted into the opening 24. Cores of the coated wires 26 of the cable 14 are connected electrically to the terminals in the respective cavities 22.

Figure 6:
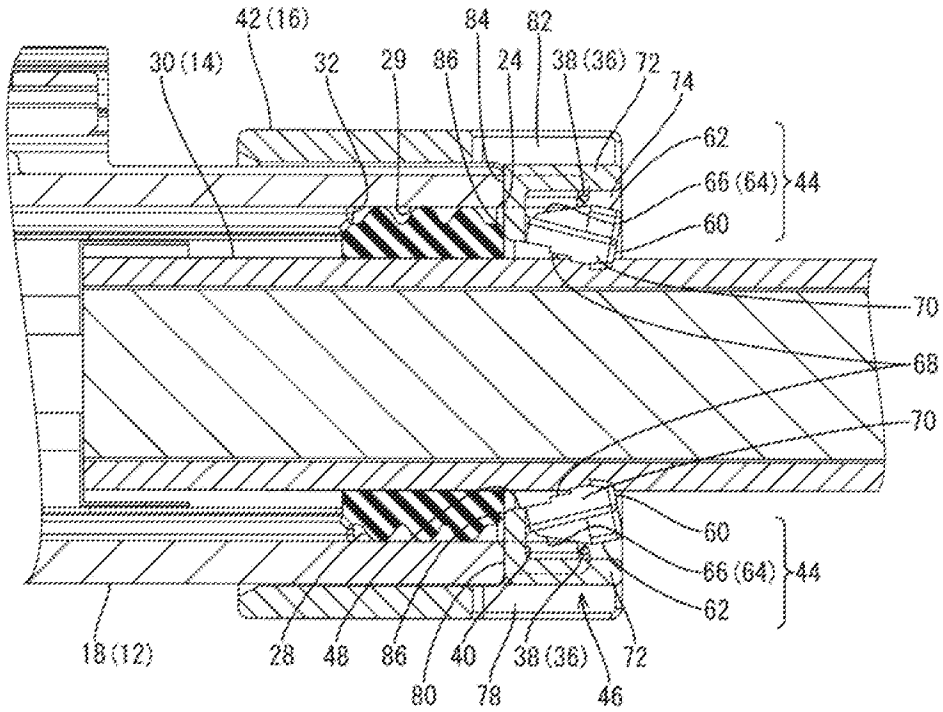
FIG. 6 is a section along A-A in FIG. 5.

As shown in FIG. 6, the cable 14 is inserted through an annular seal ring 28 that is accommodated in the opening 24. The outer peripheral surface of the seal ring 28 is resiliently in contact with an inner peripheral surface 29 in the opening 24 of the terminal accommodating portion 18. Further, the inner peripheral surface of the seal ring 28 is resiliently in contact with an outer peripheral surface 30 of the cable 14. In this way, fluid (e.g. water) cannot enter the terminal accommodating portion 18 through the opening 24 of terminal accommodating portion 18. A front contact wall 32 is provided in the terminal accommodating portion 18 and is configured to contact the front surface of the seal ring 28 to prevent forward displacement of the seal ring 28 in the terminal accommodating portion 18.

Figure 3:
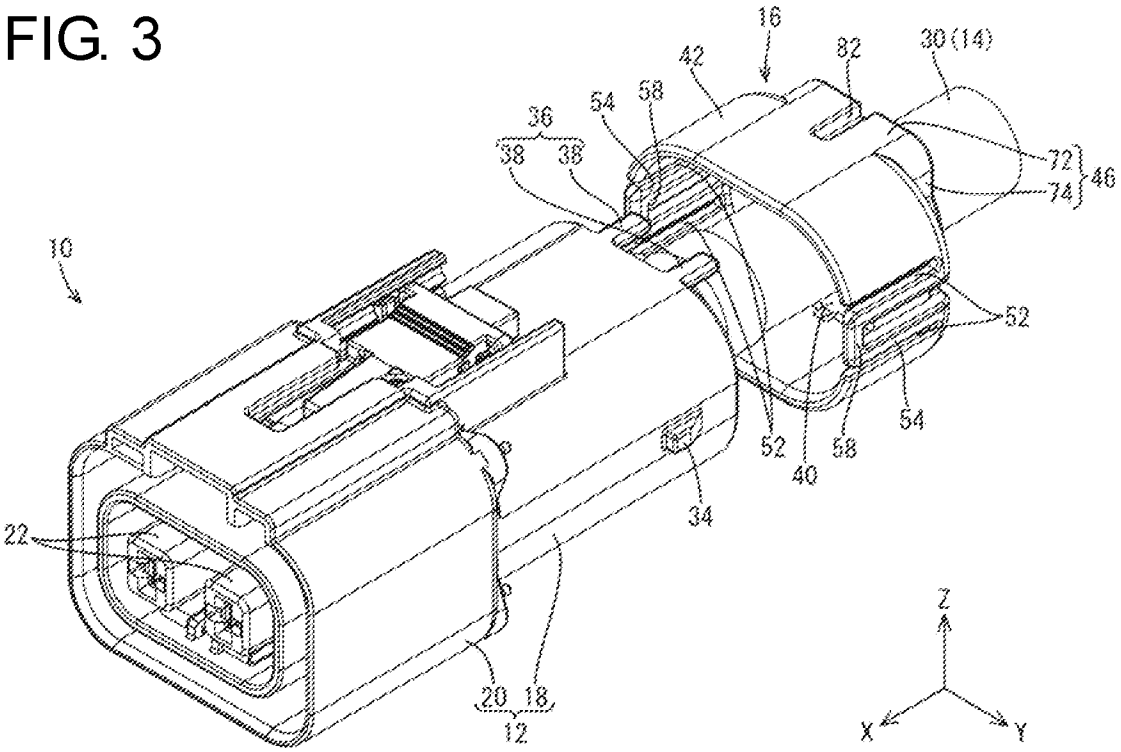
FIG. 3 is a front perspective view of the connector before the mounting of the retainer.
Figure 4:
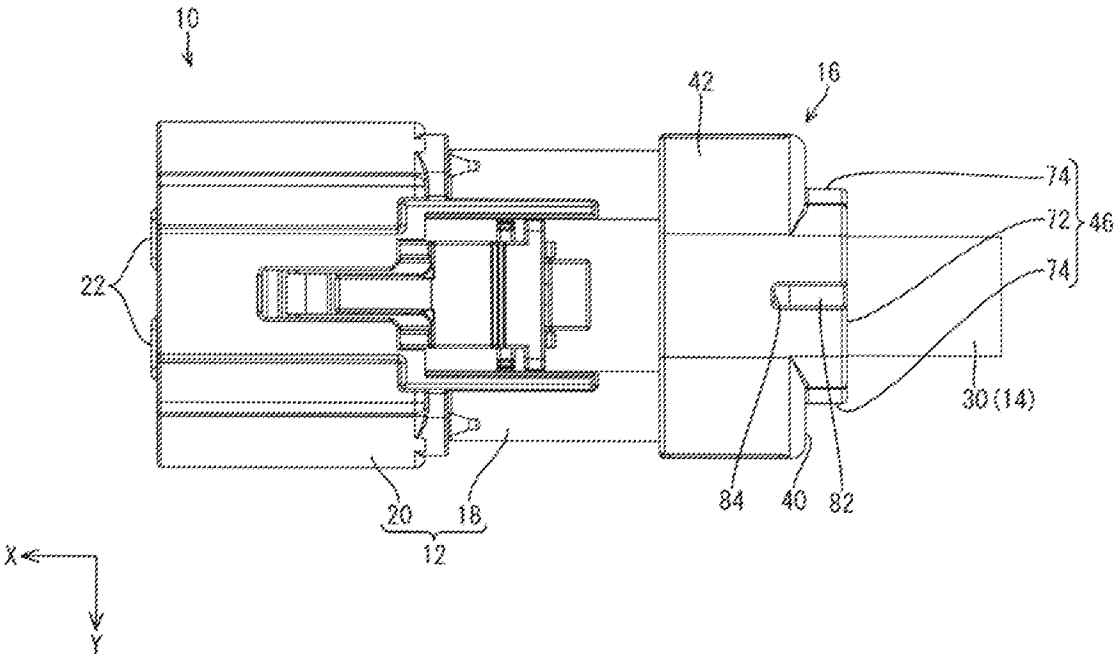
FIG. 4 is a plan view of the connector.

As shown in FIGS. 2 and 3, housing-side locks 34 project out on both side surfaces of the terminal accommodating portion 18 and prevent a retainer 16 (to be described later) from coming out rearward. The terminal accommodating portion 18 has upper and lower pressing portions 36 projecting respectively from an upper opening edge and a lower opening edge of the opening 24.

The upper pressing portion 36 has left and right individual pressing portions 38 cantilevered rearward from the upper edge of the opening 24, and the individual pressing portions 38 are spaced by a predetermined distance in a lateral direction, as shown in FIG. 2. Similarly, the lower pressing portion 36 has left and right individual pressing portions 38 cantilevered rearward from the lower edge of the opening 24.

Figure 9:
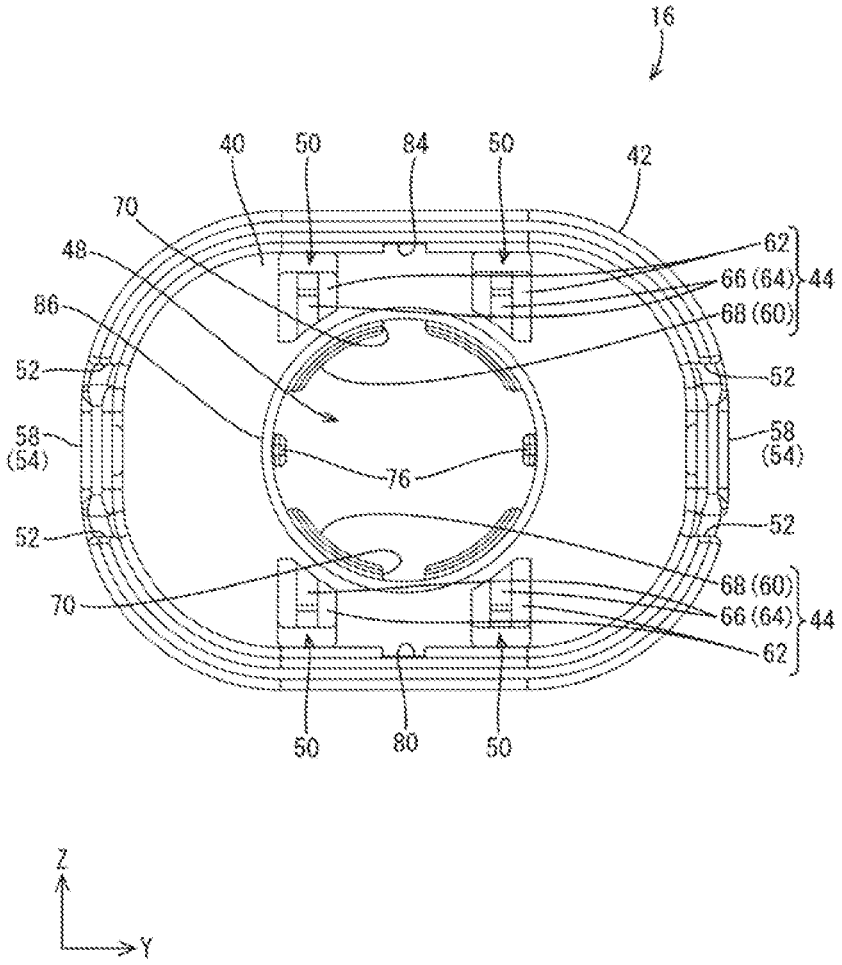
FIG. 9 is a front view of the retainer.
Figure 10:
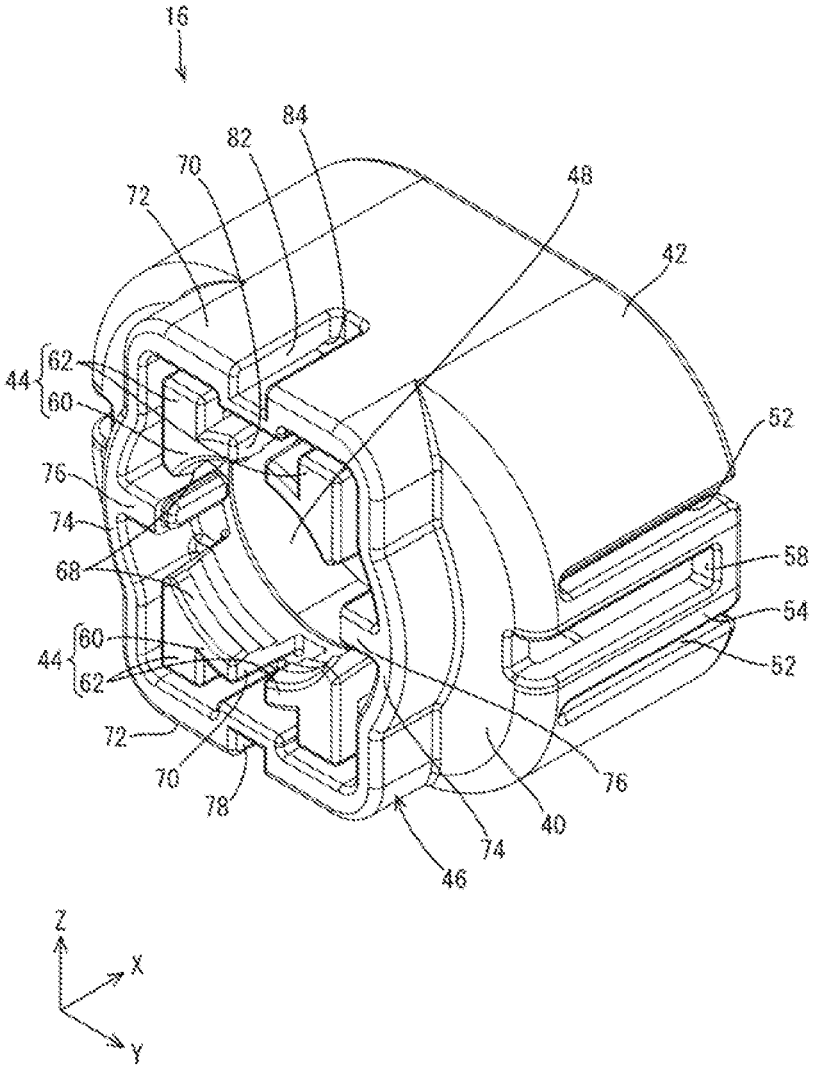
FIG. 10 is a front perspective view of the retainer.

The retainer 16 is for holding the cable 14 and the seal ring 28 in the housing 12 and includes, as shown in FIG. 10, a base wall 40 in the form of an elliptical plate long in the lateral direction, a retainer-side receptacle 42 open forward from the outer peripheral edge of the base wall 40, a frame 46 projecting rearward from the rear surface of the base wall 40 and upper and lower locking lances 44 projecting rearward from the rear surface of the base wall 40. As shown in FIG. 1, the retainer 16 is mounted on the housing 12 so that the retainer-side receptacle 42 at least partly covers the opening 24 of the terminal accommodating portion 18. As shown in FIG. 9, an intermediate position of the base wall 40 has a first insertion hole 48 through which the cable 14 is inserted and four second insertion holes 50 through which the left and right individual pressing portions 38 on an upper side and the left and right individual pressing portions 38 on a lower side are inserted respectively.

As shown in FIG. 3, two first slits 52 cut in the front-rear direction are provided in each of the side surfaces of the retainer-side receptacle 42 while being spaced by a predetermined distance in a vertical direction. In this way, left and right lock arms 54 are formed and are resiliently displaceable in the lateral direction. Each of the lock arms 54 has an opening long in the front-rear direction in a vertical center, and a front part of the opening edge of the opening serves as a retainer lock 58.

When the retainer 16 is mounted on the housing 12, the retainer-side locks 58 can contact the housing-side locks 34 from the front, as shown in FIG. 1 to prevent rearward detachment of the retainer 16 from the housing 12.

As shown in FIG. 10, the upper and lower locking lances 44 are cantilevered rearward (extending direction of the cable 14) from an opening edge of the first insertion hole 48 of the base wall 40.

As shown in FIGS. 9 and 10, the upper locking lance 44 includes a curved portion 60, left and right water suppression walls 62 and left and right projections 64.

Figure 7:
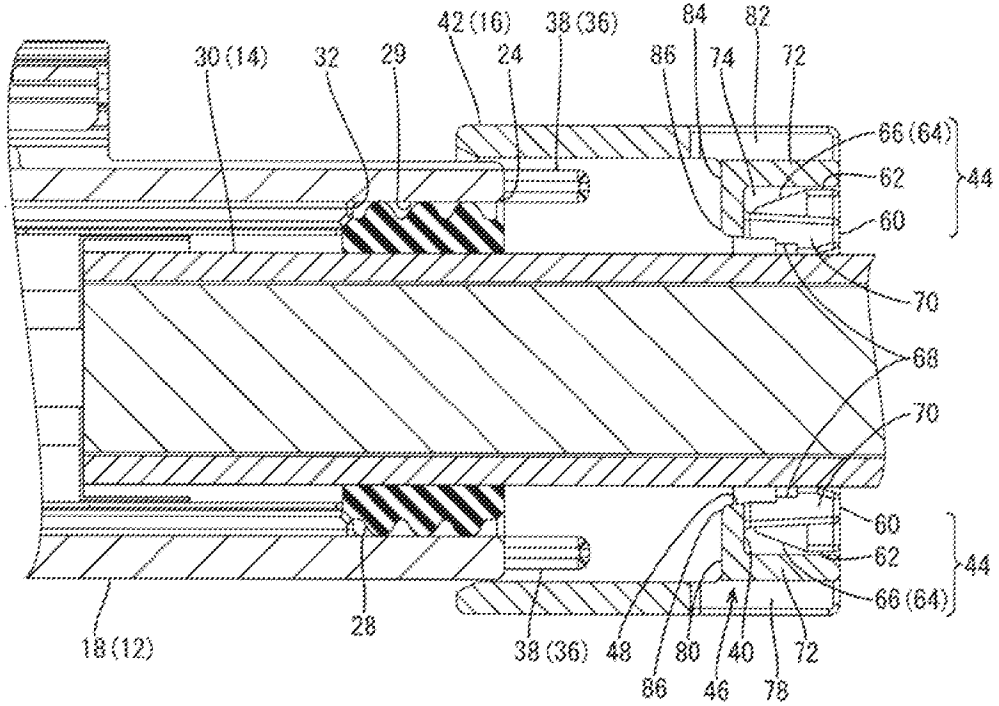
FIG. 7 is a section before the mounting of the retainer in FIG. 6.

The curved portion 60 extends rearward substantially along the extending direction of the cable 14 from the opening edge of the first insertion hole 48 as shown in FIG. 10 and has a curved shape in conformity with the outer peripheral surface 30 of the cable 14, as shown in FIG. 2. As shown in FIGS. 7 and 9, the left and right projections 64 are located forward of the water suppression walls 62, and project up from both ends of the curved portion 60 in the lateral direction (curved direction). As shown in FIG. 7, tapered surfaces 66 are provided on upper end parts of the projections 64 and incline forward toward the upper surface of the curved portion 60. Further, the lower surface of the curved portion 60 is formed into a sawtooth-like portion 68 having a sawtooth-like cross-section. The cable 14 is to be caught by the sawtooth-like portion 68 when held in the housing 12, as shown in FIG. 6. Thus, a holding force for the cable 14 is improved. Further, since the curved portion 60 extends in the extending direction of the cable 14, a contact area between the sawtooth-like portion 68 and the cable 14 is large and the holding force for the cable 14 is improved.

Figure 8:
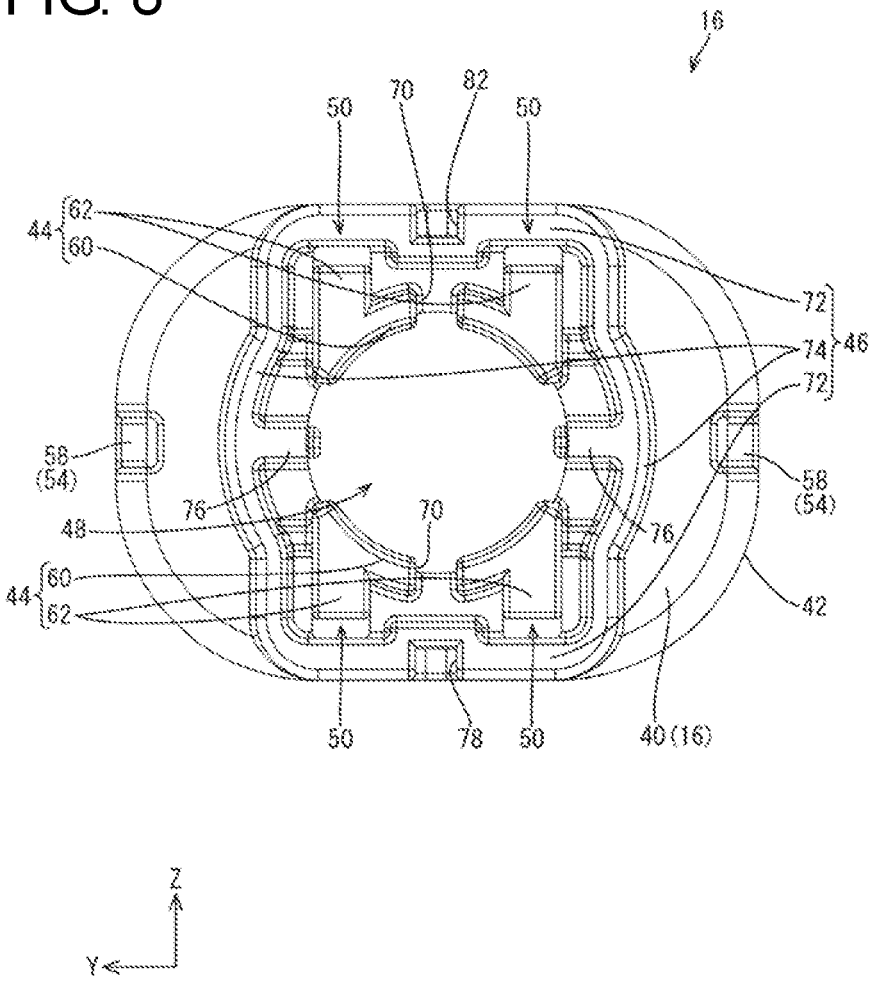
FIG. 8 is a back view of the retainer.

As shown in FIG. 10, the water suppression walls 62 are project up from a rear end of the curved portion 60. As shown in FIGS. 8 and 9, a lateral width of the water suppression walls 62 is equal to a lateral opening width of the second insertion holes 50, and the water suppression walls 62 are disposed so that no clearance is formed between and right ends of the water suppression walls 62 and left and right opening edges of the second insertion holes 50 in a front view.

Figure 5:
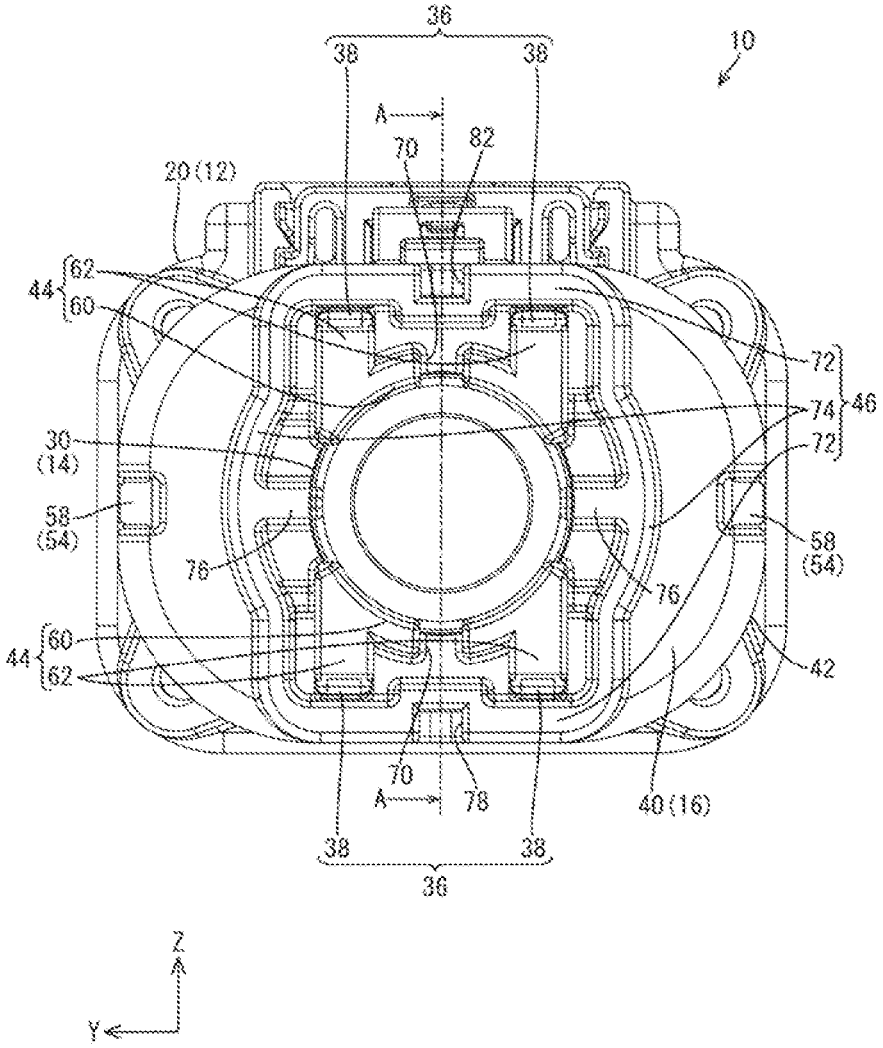
FIG. 5 is a back view of the connector.

Upper ends of the water suppression walls 62 are below upper opening edges of the second insertion holes 50, as shown in FIG. 8, and rear end parts of the individual pressing portions 38 can be seen between the upper ends of the water suppression walls 62 and the upper end opening edges of the second insertion holes 50 in a back view as shown in FIG. 5. In this way, whether or not the retainer 16 is properly mounted on the housing 12 can be confirmed from positions in front of and behind the rear end parts of the pressing portions 36.

As shown in FIG. 9, the projections 64 are accommodated in the openings of the second insertion holes 50. Thus, if the water suppression walls 62 are not provided, water may enter the opening 24 through clearances between the projections 64 and the second insertion holes 50, and the seal ring 28 may be wetted directly. However, the second insertion holes 50 are covered by the water suppression walls 62 and the individual pressing portions 38 in a back view. Thus, water that enters through the second insertion holes 50 does not directly wet the seal ring 28.

As shown in FIGS. 8 and 10, a second slit 70 extends in the front-rear direction (extending direction of the cable 14) in a center between the left and right water suppression walls 62 (and the left and right projections 64) of the curved portion 60 so that the curved portion 60 is divided laterally.

The lower locking lance 44 is vertically symmetrical with the upper locking lance 44 and has the same configuration as the upper locking lance 44, as shown in FIG. 8.

As shown in FIG. 10, the frame 46 is composed of upper and lower displacement preventing portions 72 projecting respectively from upper and lower parts of the base end wall 40 and left and right coupling portions 74 coupling both left and right end parts of the pair of upper and lower displacement preventing portions 72. The left and right coupling portions 74 are provided with left and right projections 76 projecting inward in a lateral direction of the frame 46 from surfaces facing each other. As shown in FIG. 5, the left and right projections 76 are respectively in contact with the cable 14 in the lateral direction, thereby restricting a lateral displacement of the cable 14.

When the retainer 16 is mounted on the housing 12, the upper and lower pressing portions 36 of the housing 12 are inserted between the upper and lower displacement preventing portions 72 and the projections 64 of the upper and lower locking lances 44, as shown in FIG. 6. The left and right individual pressing portions 38 of the pressing portions 36 respectively individually press the left and right projections 64 in directions to press the locking lances 44 toward the cable 14. In this way, the locking lances 44 are displaced toward the cable 14 and the sawtooth-like portions 68 of the curved portions 60 of the locking lances 44 resiliently contact the cable 14. Further, the locking lances 44 are displaced resiliently in directions opposite to the directions toward the cable 14 by a reaction force of the cable 14 generated by the resilient contact of the locking lances 44 with the cable 14. In this way, the left and right individual pressing portions 38 are displaced resiliently in the directions opposite to the directions toward the cable 14 and resiliently contact the displacement preventing portions 72 in the directions opposite to the directions toward the cable 14, as shown in FIG. 5.

A first recess 78 recessed up and inward in the lower surface of the lower displacement preventing portion 72, as shown in FIG. 5, and a first drainage port 80 is open in the bottom of the first recess 78 as shown in FIGS. 6 and 7. Further, a second recess 82 is recessed down and inward in the upper surface of the upper displacement preventing portion 72, as shown in FIG. 5, and a second drainage port 84 is open in the bottom of the second recess 82 as shown in FIGS. 2, 4, 6 and 7.

When the retainer 16 is mounted on the housing 12, the opening edge of the first insertion hole 48 of the base wall 40 contacts the seal ring 28 from behind to prevent rearward detachment of the seal ring 28 as shown in FIG. 6, and a part of the opening edge of the first insertion hole 48 that contacts the seal ring 28 from behind serves as a contact portion 86. The first drainage port 80 is located vertically below or in correspondence with the contact portion 86.

As shown in FIG. 6, the front surface of the base wall 40 contacts the opening edge of the opening 24 of the terminal accommodating portion 18 from behind to prevent a forward displacement of the retainer 16. Further, a length of the lock arms 54 of the retainer 16 is slightly longer than a length necessary to be fit to the housing-side locks 34 and the retainer 16 slightly rattles in the front-rear direction with respect to the housing 12. In this way, a tiny clearance is formed between the front surface of the base wall 40 and the edge of the opening 24 of the terminal accommodating portion 18 although not shown.

When water enters the retainer 16 and adheres to the seal ring 28, the water flows vertically down along the front surface of the base wall 40. Further, the water flowing down flows into the unillustrated clearance between the front surface of the base wall 40 and the edge of the opening 24 of the terminal accommodating portion 18 and is drained to outside through the second drainage port 84. Thus, the water does not stay near the seal ring 28. In this way, the sealing ability of the seal ring 28 will not be reduced by freezing and expansion of the water adhering to the seal ring 28 to widen the clearance between the seal ring 28 and the inner peripheral surface of the opening 24. Further, the sealing ability of the seal ring 28 will not be reduced by salt water that dries and leaves salt that widens the clearance between the seal ring 28 and the inner peripheral surface of the opening 24. Note that water having entered the retainer 16 similarly is discharged through the first drainage port 80 if the connector 10 is connected in a vertically inverted orientation.

Next, functions of this embodiment are described.

If the cable 14 is inserted through the first insertion hole 48 of the retainer 16, as shown in FIG. 7, to mount the retainer 16 on the housing 12, the sawtooth-like portions 68 on the lower surfaces of the curved portions 60 of the locking lances 44 slide on the outer peripheral surface 30 of the cable 14. The curved portions 60 of the locking lances 44 have the second slits 70 and easily deflect outward to facilitate the insertion of the cable 14.

Subsequently, the retainer 16 is displaced forward, and the upper and lower pressing portions 36 of the housing 12 are inserted respectively between the projections 64 and the displacement preventing portions 72 of the retainer 16.

When the retainer 16 is displaced forward, the tapered surfaces 66 of the left and right projections 64 contact the rear end parts of the left and right individual pressing portions 38 of the housing 12. When the retainer 16 is displaced farther forward, the left and right individual pressing portions 38 press the left and right projections 64 from above so that the left and right projections 64 resiliently displace toward the cable 14 while the tapered surfaces 66 of the left and right projections 64 and the rear end parts of the left and right individual pressing portions 38 slide against each other. In this way, the mounting of the retainer 16 on the housing 12 is completed, as shown in FIG. 6. As just described, the tapered surfaces 66 on the projections 64 reduce an insertion force for the pressing portion 36 and facilitate mounting the retainer 16 on the housing 12.

As shown in FIG. 6, the left and right pressing portions 38 press the left and right projections 64 from above. Thus, the locking lance 44 is displaced down, and the sawtooth 68 of the curved portion 60 resiliently contacts the outer peripheral surface 30 of the cable 14 to hold the cable 14 in the housing 12. At this time, the left and right projections 64 are located on both left and right sides of the curved portion 60, as shown in FIG. 9. Thus, a downward resilient displacement amount of the upper curved portion 60 is larger on the left and right sides than near the second slit 70. Thus, the curved portion 60 is displaced radially inward of the cable 14. By providing the curved portion 60 with the second slit 70 and providing the left and right projections 64 on the ends of the curved portion 60 in this way, the curved portion 60 is displaced radially inward of the cable 14 and resiliently comes into entire surface contact with the outer peripheral surface 30 of the cable 14 to improve the holding force for the cable 14.

The resilient contact of the sawtooth 68 of the curved portion 60 with the cable 14 generates a reaction force in the cable 14, and this reaction force urges the curved portion 60 and the left and right individual pressing portions 38 up. However, the left and right individual pressing portions 38 contact the displacement preventing portion 72, as shown in FIG. 5. Thus, the left and right individual pressing portions 38 cannot displace up, and the holding force for the cable 14 is not reduced by upward displacements of the left and right individual pressing portions 38. Further, the upper and lower displacement preventing portions 72 are made less deflectable in the vertical direction by having both end parts thereof coupled by the left and right coupling portions 74. In this way, the displacement preventing portions 72 are not deflected by the reaction force of the cable 14 and the holding force for the cable 14 remains strong.

The locking lance 44, the displacement preventing portion 72 and the pressing portion 36 on the lower side also exhibit functions similar to those of the locking lance 44, the displacement preventing portion 72 and the pressing portion 36 on the upper side. Further, since the cable 14 is held in the vertical direction by the upper and lower locking lances 44, the holding force for the cable 14 is improved as compared to a configuration in which only one of the upper and lower locking lances 44 is provided.

Next, it is assumed that liquid (e.g. water drops) splash on the retainer 16 from behind the retainer 16. At this time, the water drops splashed toward the second insertion holes 50 hit the water suppression walls 62 provided in front of the second insertion holes 50, thereby suppressing the entrance of the water drops into the opening 24 through the second insertion holes 50. Further, even if the water drops reach the second insertion holes 50 beyond the water suppression walls 62, these water drops hit the rear end parts of the pair of pressing portions 36. Thus, the entrance of the water drops into the opening 24 through the second insertion holes 50 is suppressed. As just described, since the second insertion holes 50 are covered by the rear end parts of the pressing portions 36 and the water suppression walls 62 in a back view as shown in FIG. 5, the water cannot enter through the second insertion holes 50.

No sealing process is applied to the inner peripheral surfaces of the first and second insertion holes 48 and 50. Thus, water drops may enter the opening 24 and adhere to the seal ring 28 in some cases. Further, water drops possibly enter through the second drainage port 84 and adhere to the seal ring 28. The water drops adhering to the seal ring 28 in this way flow vertically down along the front surface of the base wall 40 and is discharged quickly to outside through the second drainage port 84. Thus, water does not stay near the seal ring 28.

As described above, the curved portion 60 of the locking lance 44 has the second slit 70 extending in the extending direction of the cable. Thus, if the projections 64 are pressed in one direction by the pressing portion 36 of the housing 12, parts of the curved portion 60 divided by the second slit 70 are displaced in the one direction. However, the projections 64 are provided on both ends of the curved portion 60 in the curved direction. Thus, displacement amounts of both ends of the curved portion 60 in the one direction are larger than that of the side of the second slit 70 of the curved portion 60 in the one direction. In this way, the curved portion 60 is deflected radially inwardly of the cable 14 and the entire surface thereof resiliently contacts the outer peripheral surface 30 of the cable 14 to improve the holding force for the cable 14.

Further, the individual pressing portions 38 are configured to press the projections 64 individually. Thus, the weight of the pressing portion 36 can be reduced as compared to a configuration in which one pressing portion simultaneously presses the two projections 64 since a part coupling the individual pressing portions 38 is not necessary.

Further, in mounting the retainer 16 on the housing 12, the pressing portion 36 of the housing 12 gradually displaces the locking lance 44 in one direction while sliding against the tapered surfaces 66 of the projections 64 of the locking lance 44. Thus, an insertion force for the pressing portion 36 is reduced and mounting the retainer 16 on the housing 12 is easier.

Further, the cable 14 is sandwiched by the locking lances 44 and the pressing portions 36 provided on both sides across the cable 14. Thus, the holding force for the cable 14 is improved.

As described above, water that enters the retainer 16 and adheres to the seal ring 28 is discharged to outside through the first drainage port 80. Thus, the sealing ability of the seal ring 28 is not reduced due to the freezing and expansion of the water adhering to the seal ring 28 to widen the clearance between the seal ring 28 and the inner peripheral surface of the opening 24 of the housing 12.

Further, the first drainage port 80 is vertically below the contact portion 86 that is configured to contact with the seal ring 28. Thus, water adhering to the seal ring 28 and flowing down along the contact portion 86 can be discharged quickly through the first drainage port 80.

Further, since the second drainage port 84 is vertically below the contact portion 86 if the connector 10 is mounted in a vertically inverted orientation. Thus, water having entered the retainer 16 can be discharged through the second drainage port 84.

As described above, the number of components can be reduced as compared to a configuration in which the cable 14 is held by a separate component resiliently contacting the cable 14 by providing the retainer 16 with the locking lances 44 for holding the cable 14 by resiliently contacting the cable 14. Further, by providing the retainer 16 with the displacement preventing portions 72, the pressing portions 36 of the housing 12 cannot displace in directions opposite to contacting directions with the locking lances 44 due to a reaction force of the cable 14 generated by the resilient contact of the locking lances 44 with the cable 14. In this way, the holding force for the cable (wire) 14 is strong.

Further, a contact surface of the locking lance 44 and the cable 14 is curved in conformity with the outer peripheral surface 30 of the cable 14 and extends in the extending direction of the cable 14. Thus, a contact area of the locking lance 44 and the cable 14 is large.

Further, the pressing portions 36 of the housing 12 gradually displace the locking lances 44 toward the cable 14 while sliding on the tapered surfaces 66 of the projections 64 when the retainer 16 is mounted on the housing 12. Thus, an insertion force for the pressing portions 36 is reduced and work to mount the retainer 16 on the housing 12 is easier.

Further, the cable 14 is sandwiched by the two locking lances 44. Thus, the holding force for the cable 14 is high.

Further, both ends of the displacement preventing portions 72 are coupled by the coupling portions 74. Thus, the displacement preventing portions 72 are made less deflectable by the reaction force of the cable 14 and the holding force for the cable 14 is improved as compared to a configuration in which the coupling portions 74 are not provided.

Further, the two projections 76 contact the cable 14 in directions intersecting resilient displacing directions of the locking lances 44. Thus, displacements of the cable 14 in the directions intersecting the resilient displacing directions of the locking lances 44 is restricted.

The invention is not limited to the above described and illustrated embodiment. For example, the following various modes also are included.

Although the cable 14 is held in the housing 12 by the pair of upper and lower locking lances 44 of the retainer 16 respectively resiliently contacting the cable 14 in the vertical direction in the above embodiment, left and right locking lances may be provided and resiliently contact the cable in the lateral direction. Further, one locking lance may be provided and resiliently contact the cable in one direction to hold the cable.

Although the pressing portion 36 of the housing 12 is composed of the left and right individual pressing portions 38 and the left and right individual pressing portions 38 respectively press the left and right projections 64 in the above embodiment, one pressing portion may simultaneously press the left and right projections 64.

Although the lateral width of the water suppressing walls 62 is equal to the lateral opening width of the second insertion holes 50 in the above embodiment, the lateral width of the water suppressing walls 62 may be larger than the lateral opening width of the second insertion holes 50.

Although the locking lances 44 are provided with the projections 64 and the pressing portions 36 of the housing 12 press the projections 64 in the above embodiment, projections may be provided on pressing portions and the projections of the pressing portions may press curved portions of locking lances instead of providing the locking lances with the projections.

Although the displacement preventing portions 72 are made less deflectable by coupling the ends of the upper and lower displacement preventing portions 72 respectively by the left and right coupling portions 74 in the above embodiment, displacement preventing portions may be made less deflectable, for example, by being thickened without providing the left and right coupling portions 74.

REFERENCE SIGNS

10: connector
12: housing
14: cable (wire)
16: retainer
24: opening
28: seal ring
29: inner peripheral surface
30: outer peripheral surface
36: pressing portion
38: individual pressing portion
44: locking lance
60: curved portion
64: projection
66: tapered surface
70: second slit (slit)
72: displacement preventing portion
74: coupling portion
80: first drainage port
84: second drainage port
86: contact portion

What is claimed is:

1. A connector, comprising:

a housing having a terminal accommodating portion extending in forward to rearward directions, and including rearwardly-facing opening into which a wire at least partly is to be inserted; and a retainer to be mounted on the housing from the opening side, the retainer including a base wall and a frame projecting rearward from the base wall, the base wall having an insertion opening through which the wire is received, at least one locking lance cantilevered rearward from an opening edge of the insertion hole to substantially face the wire and resiliently displaceable substantially toward the wire, the retainer holding the by the at least one locking lance resiliently contacting the wire;

wherein:

the housing includes at least one cantilevered pressing portion projecting from an opening edge of the rearwardly-facing opening;

the at least one pressing portion resiliently displaces the at least one locking lance substantially toward the wire to resiliently bring the at least one locking lance into contact with the wire by pressing the at least one locking lance substantially in a direction toward the wire; and the retainer includes at least one displacement preventing portion configured to prevent a displacement of the at least one pressing portion in a direction substantially opposite to a contacting direction with the at least one locking lance by contacting the at least one pressing portion substantially in the direction toward the wire.

2. The connector of claim 1, wherein the at least one locking lance is to be brought into surface contact with the wire.

3. The connector of claim 1, wherein a contact surface of the at least one locking lance with the wire has a curved shape substantially in conformity with an outer peripheral surface of the wire.

4. The connector of claim 1, wherein at least one projection projects on a surface of the at least one locking lance substantially facing the at least one pressing portion.

5. The connector of claim 4, wherein the at least one pressing portion of the housing projects in a direction substantially opposite to a mounting direction of the retainer and resiliently displaces the at least one locking lance toward the wire by pressing an end part of the at least one projection substantially in a projecting direction.

6. The connector of claim 4, wherein the at least one projection has at least one tapered surface inclined toward the facing surface of the at least one locking lance in the mounting direction of the retainer from the end part of the at least one projection in the projecting direction.

7. The connector of claim 1, wherein the at least one locking lance comprises two locking lances, the at least one displacement preventing portion comprises two displacement preventing portions of the retainer, and the at least one pressing portion comprises two pressing portions provided opposite each other across the wire.

8. The connector of claim 7, wherein both ends of the displacement preventing portions are coupled by two coupling portions.

9. The connector of claim 8, wherein the coupling portions are provided substantially across the wire.

10. The connector of claim 8, wherein the coupling portions include two projections projecting in directions intersecting resilient displacing directions of the locking lances from surfaces facing the wire; and end parts of the projections are to be brought respectively in contact with the wire.

* * * * *